US007296703B2

(12) United States Patent
Lane

(10) Patent No.: US 7,296,703 B2
(45) Date of Patent: Nov. 20, 2007

(54) HOT-FILLABLE BLOW MOLDED CONTAINER WITH PINCH-GRIP VACUUM PANELS

(75) Inventor: Michael T Lane, Brooklyn, MI (US)

(73) Assignee: Amcor Limited, Abbotsford, Victoria (AU)

( * ) Notice: Subject to any disclaimer, the term of this patent is extended or adjusted under 35 U.S.C. 154(b) by 329 days.

(21) Appl. No.: 11/057,527

(22) Filed: Feb. 14, 2005

(65) Prior Publication Data

US 2006/0180568 A1 Aug. 17, 2006

(51) Int. Cl.
*B65D 1/02* (2006.01)
*B65D 23/10* (2006.01)

(52) U.S. Cl. ..... 215/384; 215/381; 215/398; 220/666; 220/669; 220/771

(58) Field of Classification Search ..... 215/381–384, 215/398, 900; 220/675, 771, 666, 669; D9/530
See application file for complete search history.

(56) References Cited

U.S. PATENT DOCUMENTS

| | | | |
|---|---|---|---|
| 4,804,097 | A | 2/1989 | Alberghini et al. |
| 4,890,752 | A | 1/1990 | Ota et al. |
| 4,993,565 | A | 2/1991 | Ota et al. |
| 5,141,120 | A | 8/1992 | Brown et al. |
| 5,141,121 | A | 8/1992 | Brown et al. |
| 5,148,930 | A | 9/1992 | Ota et al. |
| 5,165,557 | A | 11/1992 | Ota et al. |
| 5,199,587 | A | 4/1993 | Ota et al. |
| 5,226,550 | A | 7/1993 | Mikolaitis et al. |
| D344,457 | S | 2/1994 | Prevot et al. |
| 5,392,937 | A | 2/1995 | Prevot et al. |
| 5,472,105 | A | 12/1995 | Krishnakumar et al. |
| 5,598,941 | A | 2/1997 | Semersky et al. |
| 5,758,790 | A | 6/1998 | Ewing, Jr. |
| D419,872 | S | 2/2000 | Lane |
| D429,152 | S | 8/2000 | Lane |
| D429,164 | S | 8/2000 | Peek et al. |
| 6,233,920 | B1 | 5/2001 | Lane et al. |
| 6,375,025 | B1 | 4/2002 | Mooney |
| 6,390,316 | B1 | 5/2002 | Mooney |
| 6,439,413 | B1 | 8/2002 | Prevot et al. |
| D467,505 | S | 12/2002 | Iizuka et al. |
| 6,494,333 | B2 | 12/2002 | Sasaki et al. |
| 6,564,959 | B2 | 5/2003 | Saito et al. |
| 6,616,001 | B2 | 9/2003 | Saito et al. |
| 6,640,990 | B2 | 11/2003 | Saito et al. |
| D486,071 | S | 2/2004 | Deubel et al. |
| 6,698,606 | B2 | 3/2004 | Deubel et al. |
| 6,739,467 | B2 | 5/2004 | Saito et al. |
| 6,796,450 | B2 | 9/2004 | Prevot et al. |
| 6,981,604 | B2 * | 1/2006 | Iizuka et al. ..... 215/381 |
| 2004/0134872 | A1 * | 7/2004 | Sasaki et al. ..... 215/384 |
| 2004/0155008 | A1 | 8/2004 | Lane et al. |

* cited by examiner

*Primary Examiner*—Sue A. Weaver
(74) *Attorney, Agent, or Firm*—Harness, Dickey & Pierce, P.L.C.

(57) ABSTRACT

A polymer container suitable for hot-filling featuring a pinch-grip vacuum panel combination having a flexible-field and a generally ridged pinch-grip that accommodates vacuum related forces.

17 Claims, 2 Drawing Sheets

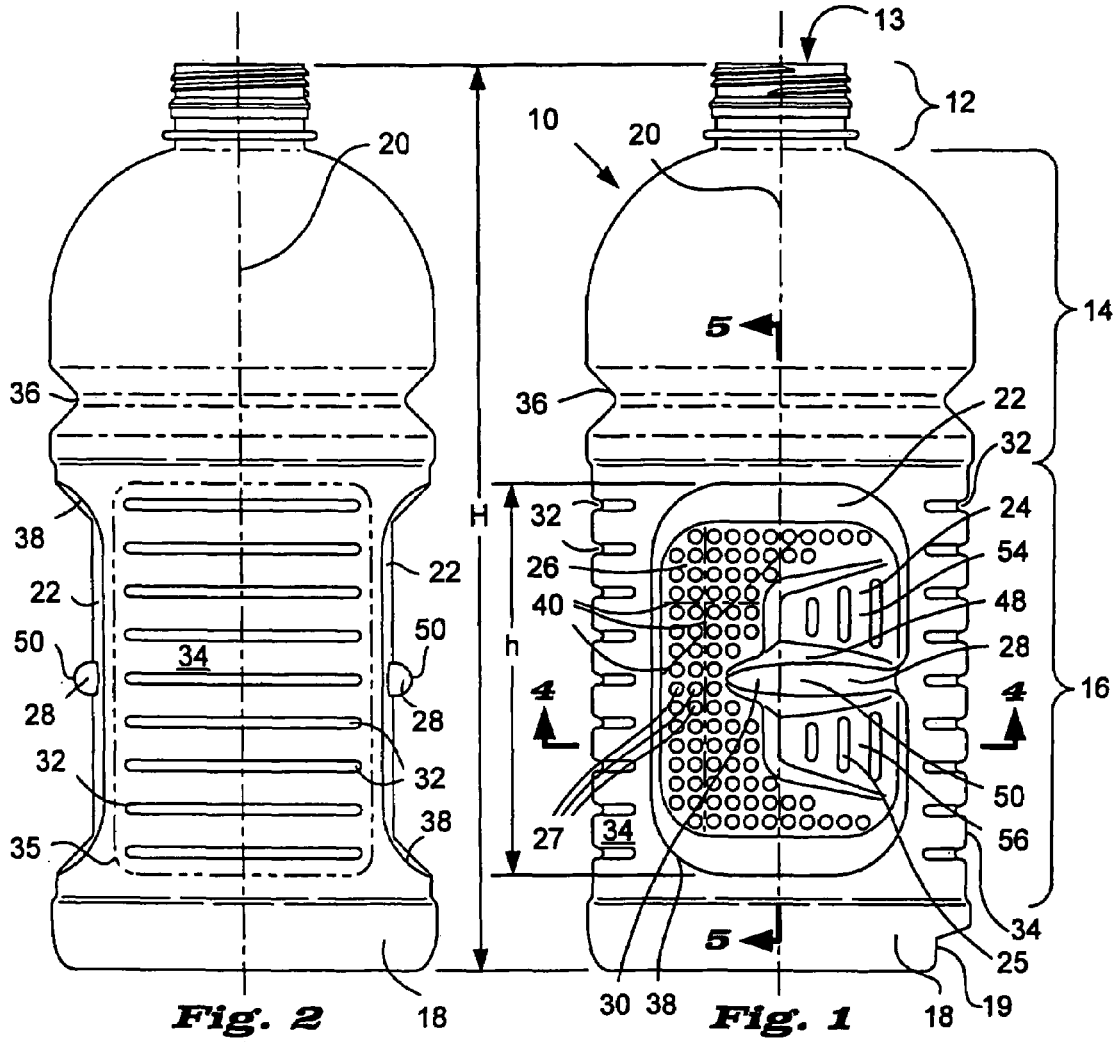
Fig. 3
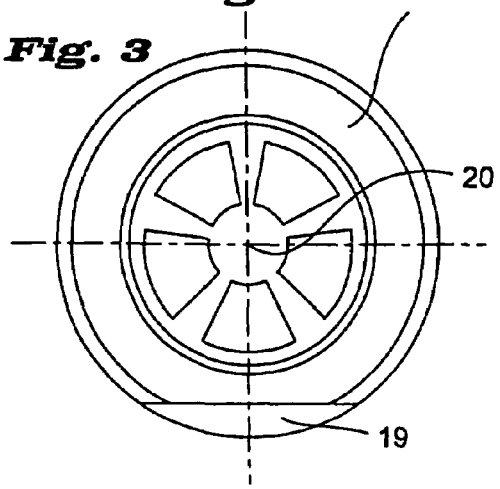

HOT-FILLABLE BLOW MOLDED CONTAINER WITH PINCH-GRIP VACUUM PANELS

TECHNICAL FIELD OF INVENTION

This invention generally relates to a hot-fillable, blow molded container made of polymer materials, such as polyethylene terephthalate (PET) or other similar polyester materials, having at least one pair of panel sections capable of resisting undesirable deformation that accommodates reductions in product volume during cooling of a hot-filled product. The container has a pinch-grip within each of the at least one pair of panel sections facilitating container handling by a consumer.

BACKGROUND

Packagers, to ensure adequate sterilization, often fill bottles and containers with liquids or products at an elevated temperature of approximately 180° F. to 205° F. (82° C. to 96° C.) and seal with a closure before cooling. Manufacturers generally refer to this as a "hot-fill" container or as a "hot-filling" process. As the sealed container cools, a slight vacuum, or negative pressure, forms inside causing the container to slightly change shape, particularly, when made of polymer materials and generally having a somewhat flexible nature.

Typically, although not always, manufacturers produce these hot-fill containers in polyester materials, such as polyethylene terephthalate (PET), using a "stretch blow-molding" process, well known in the art, that substantially biaxially orients material molecular structure within the container. While PET materials are typical, other polymer materials, such as polypropylene, polyethylene, polycarbonate, and other polyesters, such as polyethylene naphthalate, are feasible using a variety of container production processes, also well known in the art, which may or may not establish the biaxial oriented material molecular structure.

Container and bottle designers attempting to control the change-in-shape from hot-fill often incorporate a plurality of generally recessed vacuum panels within a sidewall around the container's body. Those skilled in the art are well aware of a variety of vacuum panel configurations. The vacuum panels tend to focus the change-in-shape allowing the container to retain a pleasing generally uniform appearance. Retaining the pleasing generally uniform appearance is an important consideration to the packager and its customers. If the container should collapse in an un-uniform manner, the container appearance becomes less pleasing and the customer becomes reluctant to purchase, believing the product damaged.

Containers having a capacity between approximately one liter and three liters often feature a grip means to facilitate handling by the consumer, that is, to facilitate an easy confident grip of the container by thumb and forefingers of a hand. Accordingly, container and bottle designers often incorporate a grip surface typically within two diametrically apposed vacuum panels thereby allowing the vacuum panels to function together as a convenient grip or pinch-grip. Often the entire vacuum panel becomes the grip; however, the grip can also be a subsection of a substantially larger vacuum panel. Those skilled in the art are aware of a variety of grip-vacuum-panel configurations.

Packagers often place one or more spot labels on arcuate container surfaces between the grip-vacuum panels that often have a plurality of relatively shallow recessed ribs to increase rigidity, thus rendering these arcuate surfaces between the grip- or pinch-grip-vacuum panels unavailable to receive other generally recessed vacuum panels in addition to those used for the grip. Often containers having pinch-grip vacuum panels have only the two diametrically apposed vacuum panels, each with a grip surface, which must accommodate all vacuum related forces to the container while retaining the pleasing generally uniform appearance.

Containers having only two large diametrically apposed vacuum panels and the generally circular cross-sectional configuration are particularly vulnerable to unwanted changes-in-shape if the panels do not properly accommodate the vacuum related forces often causing the container to twist and assume a more oval cross-sectional or skewed oval cross-sectional configuration generally unpleasing to the consumer or customer.

Packagers attempting to reduce cost, require containers to have less material or to be lighter in weight. Said differently, the sidewall of the container has a thinner thickness and therefore is not as rigid. Accordingly, containers lighter in weight are particularly vulnerable to unwanted changes-in-shape, a particular problem for containers having the pinch-grip and otherwise a generally circular cross-sectional configuration featuring only two diametrically apposed vacuum panels with spot-labeling surfaces between. To function properly, the vacuum panels must be extremely flexible relative to other areas of the container.

However, while the panels accommodate vacuum related forces, the grip surfaces themselves must resist pinch-grip related forces from thumb and forefingers of the hand while the consumer pours contents from the container. Consequently, pinch-grip vacuum panels must be both ridged and flexible. Ridged to allow the customer or consumer to grip the container with ease and confidence, and flexible to accommodate vacuum related forces while retaining a uniform generally circular cross-sectional configuration without skewed oval cross-sectional appearance.

Accordingly, the inventor has discovered a new and novel pinch-grip vacuum panel combination providing controlled flexibility necessary to accommodate vacuum related forces thereby retaining the pleasing generally uniform appearance of the polymer container, while providing the rigidity necessary to function as a grip, thereby providing confidence to the consumer while handling the container.

SUMMARY OF INVENTION

A container made of polymer materials includes a neck finish portion suitable for receiving a closure, a shoulder portion adjacent the neck finish portion, a body portion adjacent the shoulder portion, and a bottom portion adjacent the body portion. The body portion includes a sidewall having at least one pair of substantially diametrically apposed vacuum panels. Each of the at least one pair of diametrically apposed vacuum panels include a pinch-grip portion formed therein and a flexible-field adjacent to the pinch-grip portion. The pinch-grip portion includes a bridge with a tongue portion extending into the flexible-field.

The vacuum panel with the pinch-grip portion has an edge and the bridge has an end adjacent the edge. The flexible-field has an overall generally convex surface appearance in cross section. The edge has an adjacent zone that generally pivots in a hinge-like action and the convex surface transitions into a generally overall concave surface, both in response to an external force. The flexible-field has a plurality of indented dimples arranged in uniformly spaced positions forming a series of horizontal, vertical, and diagonal rows. The uniformly spaced positions of the plurality of indented dimples form a series of substantially horizontal, vertical, and diagonal flex-lines extending between the dimples.

The container manufacturer typically makes the container of substantially a polyester, polypropylene, or polyethylene material and the polyester typically is substantially polyethylene terephthalate or polyethylene naphthalate.

From the following description, the appended claims, and the accompanying drawings, additional benefits and advantages of the present invention will become apparent to those skilled in the art to which this invention relates.

BRIEF DESCRIPTION OF DRAWINGS

FIG. 1 is a side elevational view of a container.

FIG. 2 is a front elevational view of the container shown in FIG. 1.

FIG. 3 is a bottom view of the container shown in FIG. 2.

DETAILED DESCRIPTION

Figure 4:
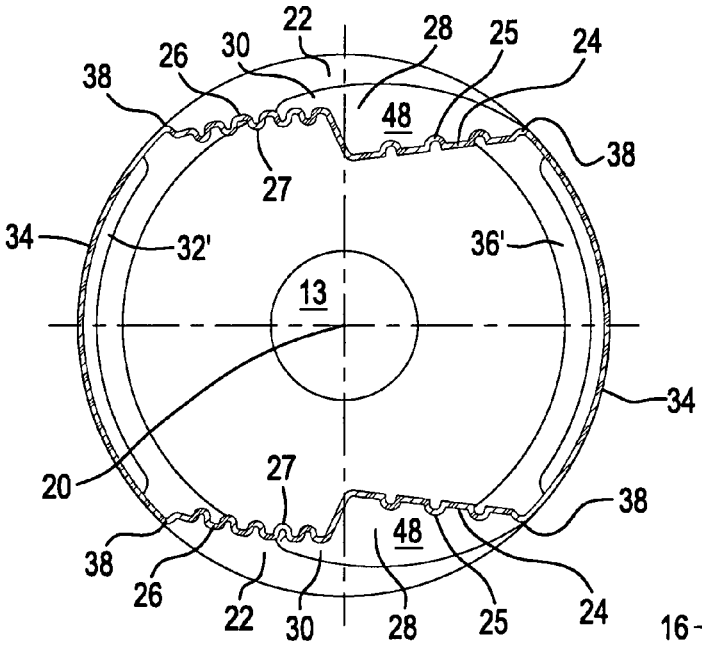
FIG. 4 is a cross-sectional view taken along line 4-4 of FIG. 1.

FIG. 1 illustrates a hot-fillable container 10 made of a polymer material, such as polypropylene, polyethylene terephthalate (PET), or other polymer materials. Container 10 has a neck finish portion 12 with an opening 13 suitable to receive a closure (not shown), a shoulder portion 14, a body portion 16, and a bottom portion 18 all having a centerline 20.

Body portion 16 features an indented vacuum panel 22 having a pinch-grip 24 with grip ridges 25, a flexible-field 26, and a bridge 28 with a tongue 30 extending across pinch-grip 24 and into flexible-field 26. Container 10 has an overall height H. To be most effective, vacuum panel 22 has a height h approximating that of body portion 16 that in turn is approximately 50 to 75 percent of the container 10 height H. Those skilled in the art realize grip ridges 25 create indentations that allow fingers and thumb of an average hand to effectively secure a hold to the container 10 while handling and can be any convenient configuration, such as vertical ridges (as shown in FIG. 1), horizontal ridges, dimples, roughened texturing, and the like. Shoulder portion 14 features a groove 36 useful for stiffening container 10 thereby helping container 10 to retain a generally uniform configuration.

FIG. 2 is a front view of container 10 showing indented vacuum panels 22 on two sides of body portion 16 and therebetween an arcuate surface 34 with indented ribs 32 useful for stiffening arcuate surface 34. Indented ribs 32 extend horizontally across arcuate surface 34, and are relatively evenly spaced extending from the top to the bottom of body portion 16. Arcuate surface 34 typically receives a label 35 shown in phantom line that covers all of the ribs 32; moreover, container 10 has two arcuate surfaces 34, both of which typically receive label 35. In addition, arcuate surface 34 has a chordal length generally corresponding to a width of vacuum panel 22 that is a compromise between balancing vacuum panel 22 effectiveness, pinch-grip 24 suitable to fit the average hand, and desired size of label 35. Bottom portion 18 features a notch 19 (FIG. 1) useful for uniformly positioning the container 10 on a filling-line (not illustrated) so as to accurately receive label 35.

FIG. 3 is a bottom view of container 10 showing its generally circular configuration about centerline 20. In the preferred embodiment, container manufacturers will manufacture container 10 using a well-known stretch-molding heat-setting process wherein, the polymer material is generally molecularly oriented, that is, the polymer material molecular structure is mostly biaxially oriented. The exception is that the molecular structure of some material within the neck finish portion 12 and some material within subportions of the bottom portion 18 may not be substantially biaxially oriented.

The well-known stretch-molding heat-setting process for making the hot-fillable container 10 generally involves first manufacture of a preform (not illustrated) of a polyester material, such as polyethylene terephthalate, having a shape well known to those skilled in the art similar to a test-tube with a generally cylindrical cross-section with a length approximately 50 percent that of the container height. A machine (not illustrated) places the preform heated to a temperature between approximately 190° F. to 250° F. (88° C. to 121° C.) into a mold cavity (not illustrated) having a shape similar to the container 10 and at a temperature between approximately 250° F. to 350° F. (121° C. to 176° C.). A stretch rod apparatus (not illustrated) stretches or extends the heated preform within the mold cavity to a length approximately that of the container thereby molecularly orienting the polyester material in an axial direction generally corresponding with centerline 20. While the stretch rod is extending the preform, air having a pressure between 300 PSI to 600 PSI (2.068 MPa to 4.137 MPa) assists extending the preform in the axial direction while expanding the preform in a circumferential or hoop direction thereby substantially conforming the polyester material to the shape of the mold cavity and further molecularly orienting the polyester material in a direction generally perpendicular to the axial direction thus establishing the biaxial molecular orientation of the polyester material in most of the container. The pressurized air holds the mostly biaxially oriented polyester material against the mold cavity for a period of approximately 2 to 5 seconds before removal of the container from the mold cavity.

FIG. 4 is a cross-section view taken along line 4-4 in FIG. 1 showing a pair of diametrically apposed indented vacuum panels 22 with their indented pinch-grip 24, and flexible-field 26 featuring a plurality of dimples 27, each dimple 27 having a depth approximately half that of its width. Preferably, dimples 27 have uniform relatively close spacing in horizontal, vertical, and diagonal rows and have a generally hemispherical shape indented inward generally in a direction toward centerline 20. Those skilled in the art will recognize that polygonal shapes for dimple 27, such as square, rectangle, diamond, and the like, could be equally effective. FIG. 4 also illustrates rib interior surface 32' of indented rib 32 and groove interior surface 36' of groove 36.

Between the dimples 27 is a plurality of horizontal, vertical, and diagonal flex areas illustratively represented in phantom as flex lines 40 in FIG. 1. Container 10 has an overall average wall thickness. Some areas of container 10 are thicker than other areas. In general, a natural by-product of the stretch-molding heat-setting process for making the hot-fillable container 10 is that wall thickness varies. The flexible-field 26 uses this natural variation to its advantage. The wall thickness of each dimple 27 will tend to be slightly thicker than the wall thickness adjacent and between any two dimples, particularly if the space between any two dimples is approximately equal to the depth of the dimple, consequently establishing horizontal, vertical, and diagonal flex lines 40 between any two horizontal, vertical, and diagonal rows of dimples 27.

Figure 5:
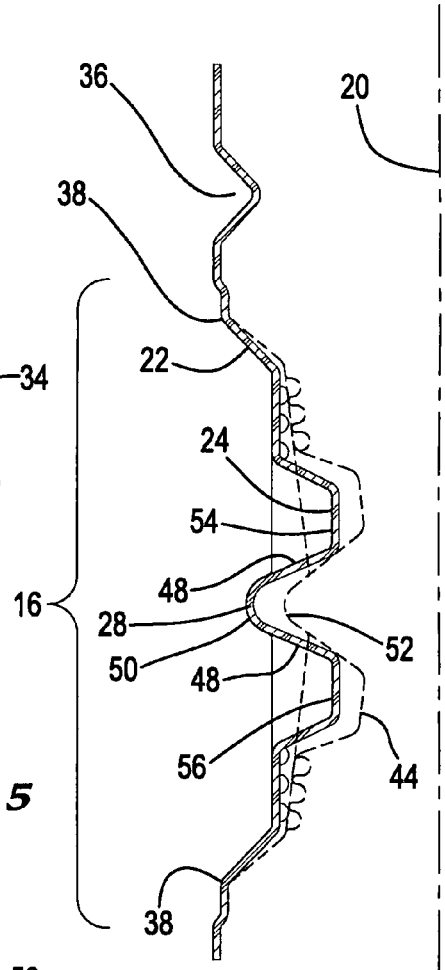
FIG. 5 is a partial cross-sectional view taken along line 5-5 of FIG. 1.

FIG. 5 is a partial cross-sectional view of container 10 taken along line 5-5 in FIG. 1 showing one indented vacuum panel 22 with its indented pinch-grip 24, and a cross-sectional view of bridge 28 having bridge sidewalls 48 and a bridge crown 50. Container 10 is for hot-fill applications where bottlers fill the container 10 with a liquid or product at an elevated temperature between approximately 180° F. to 205° F. (82° C. to 96° C.) and seal with a closure before cooling (not illustrated). As the sealed container cools, a slight vacuum, or negative pressure, forms inside causing the container to slightly change shape, particularly, when made of lightweight polymer materials and thus generally having a somewhat flexible nature.

Dashed line 44 illustrates a new position for vacuum panel 22 and pinch-grip 24 generally moving toward centerline 20 in response to vacuum related forces. While not illustrated, those skilled in the art will recognize that the diametrically apposed vacuum panel 22 and pinch-grip 24 also move toward centerline 20. A substantially continuous rounded edge 38 surrounds vacuum panel 22. Rounded edge 38 generally establishes a pivot point allowing the vacuum panel 22 to pivot in a hinge-like action when responding to external or vacuum related forces. While FIG. 5 and FIG. 6 for convenience illustrate the hinge-like action as relatively confined at rounded edge 38, the hinge-like action is generally a focused bending within a zone adjacent to either side of the rounded edge 38, that is, rounded edge 38 is approximately center to the zone.

Bridge 28 with bridge sidewalls 48 divide pinch-grip 24 into an upper grip area 54 and a lower grip area 56 thereby respectively allowing the upper grip area 54 and the lower grip area 56 to generally retain its shape. However, as with the space between any two dimples 27, bridge 28 has a depth approximately equal to its width thereby causing the wall thickness within the bridge crown 50 adjacent to pinch-grip 24 to be relatively thinner than bridge sidewalls 48 allowing localized bending (illustrated by reference numeral 52) to occur in response to vacuum related forces.

Figure 6:
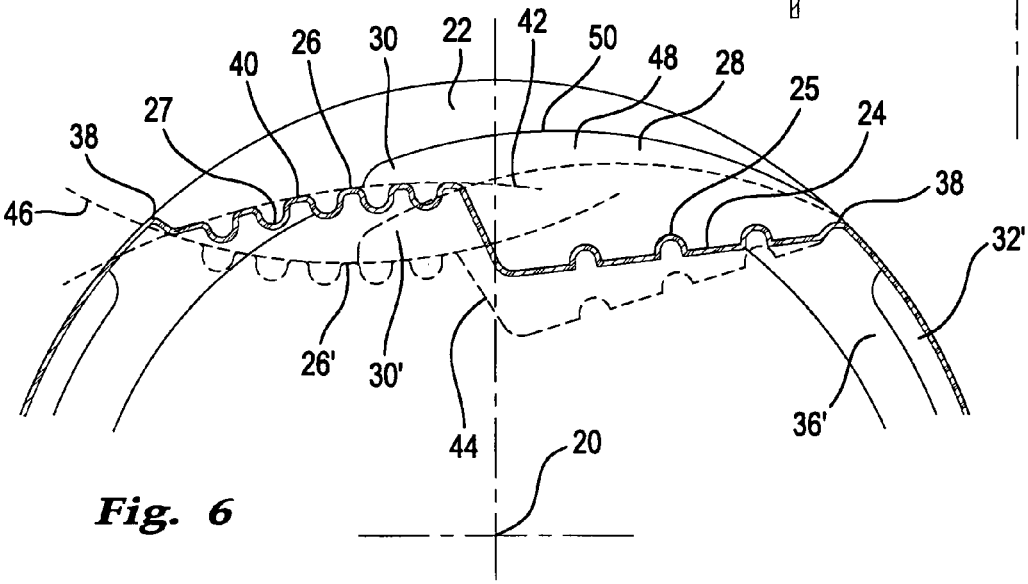
FIG. 6 is an enlarged partial cross-sectional view similar to FIG. 4.

FIG. 6 is an enlarged partial cross-sectional view of one vacuum panel 22, a view otherwise similar to FIG. 4, showing flexible-field 26 having a generally convex curvature as illustrated by first flexible-field phantom line 42. Dashed line 44 illustrates a new position for vacuum panel 22 and pinch-grip 24 generally moving toward centerline 20 in response to vacuum related forces causing flexible-field 26 to invert into a generally concave curvature as illustrated by second flexible-field phantom line 46 to become generally an inverted flexible-field 26'. The bridge 28 with an end adjacent to rounded edge 38 crosses pinch-grip 24. At an opposite end of bridge 28 is tongue 30 extending into flexible-field 26. Tongue 30 helps initiate the inversion into the inverted flexible-field 26' with repositioned tongue 30' as the end adjacent to rounded edge 38 of bridge 28 and pinch-grip 24 generally pivots about rounded edge 38, thereby providing vacuum panel 22 with its pinch-grip 24 the controlled flexibility necessary to accommodate vacuum related forces that otherwise would not be possible. Accordingly, container 10 retains a pleasing generally uniform appearance, while providing necessary rigidity to function as a grip thereby providing confidence to the consumer while handling the container.

While the preferred embodiment of container 10 features two diametrically apposed indented vacuum panels 22 each with indented pinch-grip 24, those skilled in the art will recognize that container 10 can have additional vacuum panels placed within the shoulder portion 14 and/or additional vacuum panels with or without pinch-grip features in the arcuate surface 34. The foregoing describes the preferred embodiment and certain alternatives, and one must understand that other variations are feasible that do not depart from the spirit and scope of the inventions as defined by the appended claims.

I claim:

1. A container made of polymer materials comprising:
a neck finish portion suitable for receiving a closure;
a shoulder portion adjacent said neck finish portion;
a body portion adjacent said shoulder portion; and
a bottom portion adjacent said body portion;
said body portion including a sidewall having at least one pair of substantially diametrically apposed vacuum panels, each of said at least one pair of diametrically apposed vacuum panels having a pinch-grip portion formed therein and a flexible-field adjacent to said pinch-grip portion formed therein, said flexible-field having a plurality of indented dimples formed therein;
said pinch-grip portion having a bridge with a tongue portion extending into said flexible-field.

2. The container according to claim 1, wherein said vacuum panels with said pinch-grip portion have an edge.

3. The container according to claim 2, wherein said edge has an adjacent zone that generally pivots in a hinge-like action in response to an external force.

4. The container according to claim 2, wherein said bridge has an end adjacent said edge.

5. The container according to claim 1, wherein said flexible-field has an overall generally convex shaped surface appearance in cross section.

6. The container according to claim 5, wherein said convex shaped surface becomes a generally overall concave shaped surface in cross section in response to an external force.

7. The container according to claim 1, wherein said indented dimples are arranged in uniformly spaced positions forming a series of horizontal, vertical, and diagonal rows.

8. The container according to claim 7, wherein said uniformly spaced positions of said plurality of indented dimples form a series of substantially horizontal, vertical, and diagonal flex-lines extending between said dimples.

9. The container according to claim 1, wherein said polymer materials are substantially one of a polyester, a polypropylene, and a polyethylene.

10. The container according to claim 9, wherein said polyester is substantially one of a polyethylene terephthalate and a polyethylene naphthalate.

11. A hot-filled polymer container filled with a liquid at an elevated temperature, sealed with a closure, and cooled thereby establishing a slight vacuum within said container, said container comprising:
a neck finish portion suitable for receiving the closure;
a shoulder portion adjacent said neck finish portion;
a body portion adjacent said shoulder portion; and
a bottom portion adjacent said body portion;
said body portion including a sidewall having at least one pair of substantially diametrically apposed vacuum panels, each of said at least one pair of diametrically apposed vacuum panels having a pinch-grip portion formed therein and a flexible-field adjacent to said pinch-grip portion formed therein, said flexible-field having a plurality of indented dimples formed therein;

said pinch-grip portion having a bridge with a tongue portion extending into said flexible field.

12. The container according to claim 11, wherein said temperature of the liquid is between 180° F. to 205° F. (82° C. to 96° C.).

13. The container according to claim 11, wherein said polymer is substantially one of a polyester, a polypropylene, and a polyethylene.

14. The container according to claim 13, wherein said polyester is substantially one of a polyethylene terephthalate and a polyethylene naphthalate.

15. A stretch-molded heat-set polyester container formed within a mold cavity having a temperature of approximately 250° F. to 350° F. (121° C. to 176° C.), said container comprising:

a neck finish portion suitable for receiving a closure;

a shoulder portion adjacent said neck finish portion;

a body portion adjacent said shoulder portion;

a bottom portion adjacent said body portion;

said body portion including a sidewall having at least one pair of substantially diametrically apposed vacuum panels, each of said at least one pair of diametrically apposed vacuum panels having a pinch-grip portion formed therein and a flexible-field adjacent to said pinch-grip portion formed therein, said flexible-field having a plurality of indented dimples formed therein;

said pinch-grip portion having a bridge with a tongue portion extending into said flexible field; and a generally biaxially oriented molecular structure.

16. The container according to claim 15, wherein said polyester is substantially a polyethylene terephthalate.

17. The container according to claim 15, wherein said indented dimples are arranged in uniformly spaced positions forming a series of horizontal, vertical, and diagonal rows.

* * * * *